US005867761A

United States Patent [19]

Ishida et al.

[11] Patent Number: 5,867,761

[45] Date of Patent: Feb. 2, 1999

[54] IMAGE FORMING MACHINE WITH TRANSFER ROLLER

[75] Inventors: Naoyuki Ishida; Yoshifumi Okauchi; Yukihiro Ito; Masahiko Miyazaki; Tetsuya Ichigotani; Shoji Hirano; Takahisa Nakaue, all of Osaka, Japan

[73] Assignee: Mita Industrial Co., Ltd., Osaka, Japan

[21] Appl. No.: 971,041

[22] Filed: Nov. 14, 1997

[30] Foreign Application Priority Data

Nov. 15, 1996 [JP] Japan ..... 8-304281

[51] Int. Cl.[6] ..... G03G 15/00

[52] U.S. Cl. ..... 399/388; 399/314; 399/316

[58] Field of Search ..... 399/388, 394, 399/395, 396, 76, 285, 297, 265, 279, 310, 313, 314, 315, 316, 317, 381

[56] References Cited

U.S. PATENT DOCUMENTS

| | | | |
|---|---|---|---|
| 4,260,242 | 4/1981 | Nishikawa | 399/76 |
| 4,396,273 | 8/1983 | Matsuyama et al. | 399/316 |
| 5,406,360 | 4/1995 | Asai | 399/313 |
| 5,489,974 | 2/1996 | Kamaji et al. | 399/285 |
| 5,633,703 | 5/1997 | Takenouchi et al. | 399/315 |
| 5,739,900 | 4/1998 | Isobe | 399/279 X |

*Primary Examiner*—Arthur T. Grimley
*Assistant Examiner*—Hoan Tran
*Attorney, Agent, or Firm*—Antonelli, Terry, Stout & Kraus, LLP

[57] ABSTRACT

An image forming machine having a transfer roller comprises a rotatably disposed photoconductor drum, a transfer roller disposed opposite the photoconductor drum with a predetermined gap provided therebetween, a register roller pair for feeding a transfer sheet toward a transfer area where the photoconductor drum and the transfer roller are opposed to each other, transfer sheet guide means disposed between the register roller pair and the transfer area, and a fixing roller pair for fixing a toner image transferred to the transfer sheet passing through the transfer area. The transfer sheet guide means comprises an inner guide plate and an outer guide plate, and the inner guide plate has a linear guide portion extending toward a predetermined position on the peripheral surface of the photoconductor drum. The predetermined position is set in an angular range (θ) covering 12° to 23° upstream, in the direction of rotation of the photoconductor drum, from a line connecting the center of rotation of the photoconductor drum to the center of rotation of the transfer roller, while the linear guide portion of the inner guide plate forms an angle (α) with a tangent to the photoconductor drum at the predetermined position, the angle (α) being set at 19° to 30°.

2 Claims, 3 Drawing Sheets

IMAGE FORMING MACHINE WITH TRANSFER ROLLER

FIELD OF THE INVENTION

This invention relates to an image forming machine of the type which electrostatically transfers a toner image formed on the peripheral surface of a photoconductor drum to a transfer sheet, such as an electrostatic copier or a laser printer. More specifically, the invention concerns an image forming machine equipped with a transfer roller as transfer means.

DESCRIPTION OF THE PRIOR ART

This type of image forming machine comprises a photoconductor drum disposed rotatably and passing a charging area, an electrostatic latent image forming area, a developing area, and a transfer area in this order, a charger disposed in the charging area for charging the peripheral surface of the photoconductor drum to a specific polarity, exposure means disposed in the electrostatic latent image forming area for forming an electrostatic latent image on the peripheral surface of the photoconductor drum charged to the specific polarity, a developing device disposed in the developing area for developing the electrostatic latent image formed on the peripheral surface of the photoconductor drum to a toner image, a transfer device disposed in the transfer area for transferring the toner image formed on the peripheral surface of the photoconductor drum to a transfer sheet, and a fixing device for thermally fixing the toner image transferred by the transfer device to the transfer sheet. The image forming machine also includes a transfer sheet feeder for feeding a transfer sheet to the transfer area.

A corona discharge system is generally used as the transfer device. The corona discharge type transfer device makes a corona discharger apply a corona discharge to the back of a transfer sheet fed to the transfer area, thereby to transfer the toner image formed on the peripheral surface of the photoconductor drum to the surface of the transfer sheet.

The foregoing corona discharge type transfer device, however, requires a high application voltage in order to obtain the desired amount of charge. Thus, this device generates a large amount of ozone, thereby posing the problem of environmental pollution.

To deal with this problem facing the corona discharge type transfer device, a transfer device using a so-called contact type transfer roller is put to practical use. In this type of transfer device, the transfer roller is disposed in contact with the peripheral surface of the photoconductor drum, and a bias voltage is applied to the transfer roller. When the contact type transfer roller is used, however, the contact pressure of a transfer sheet on the peripheral surface of the photoconductor drum is considerably high. This tends to cause a so-called missing phenomenon (the absence of a toner in some of characters in the transferred image), or a so-called image dust phenomenon (adhesion of scattered toner near characters in the transferred image).

To solve the above-described problems caused by the considerably high contact pressure of the transfer sheet on the peripheral surface of the photoconductor drum, a proposal has been made of a transfer device using a so-called noncontact type transfer roller. A transfer device using a noncontact type transfer roller has the transfer roller spaced from the peripheral surface of the photoconductor drum by a gap larger than the thickness of a transfer sheet, and applies a bias voltage to the transfer roller.

In such a transfer device using a noncontact type transfer roller, a transfer sheet is fed upstream, in the direction of rotation of the photoconductor drum, of a peripheral surface position of the photoconductor drum (transfer point) on a line connecting the center of rotation of the photoconductor drum to the center of rotation of the transfer roller. It is important, here, that the transfer sheet be in intimate contact with the peripheral surface of the photoconductor drum in a predetermined angular range (contact angular range) beginning at the transfer point. If this intimate contact range is narrow, a transfer failure occurs. If the intimate contact range is wide, and if the image to be transferred has a solid print area, a so-called polka dot phenomenon occurs in which whitenings about 1 mm in diameter as shown in FIG. 3 are formed. With a conventional image forming machine, therefore, a transfer sheet is set so as to be fed to an angular position about 27° upstream of the transfer point in the direction of rotation of the photoconductor drum.

The transfer sheet passes the transfer point to have the toner image formed on the peripheral surface of the photoconductor drum transferred thereto. When a front end part of this transfer sheet is nipped by a fixing roller pair of the fixing device, the transfer sheet is pulled by the carrying force of the fixing roller pair. This increases the degree of intimate contact of the transfer sheet with the peripheral surface of the photoconductor drum. The degree of intimate contact of the transfer sheet depends on the contact angular range for the contact of the transfer sheet with the peripheral surface of the photoconductor drum. When this contact angular range is narrow, the increase in the degree of intimate contact is small. When the contact angular range is broad, the transfer sheet wraps in a large amount around the peripheral surface of the photoconductor drum. Since undue force is imposed thereby during feeding, the degree of intimate contact increases. This increase in the degree of intimate contact of the transfer sheet with the peripheral surface of the photoconductor drum arouses the aforementioned polka dot phenomenon. Our experiments gave the following findings: When the contact angular range was an approximately 27° range as in the prior art, there was no problem in a transferred image present at a part of the transfer sheet which passed through the transfer point before the front end of the transfer sheet was nipped by the fixing roller pair. However, a transferred image in a latter half portion rearward of that part sometimes underwent the polka dot phenomenon.

SUMMARY OF THE INVENTION

It is an object of the present invention to provide an image forming machine having a transfer roller which can reliably prevent the occurrence of the polka dot phenomenon in the transferred image without causing a transfer failure.

To attain this object, the invention provides an image forming machine having a transfer roller, comprising a photoconductor drum disposed rotatably and having a peripheral surface on which a toner image is formed, a transfer roller disposed opposite the photoconductor drum with a predetermined gap provided therebetween for transferring a toner image formed on the peripheral surface of the photoconductor drum to a transfer sheet, a register roller pair disposed upstream, in the direction of carriage of a transfer sheet, of a transfer area where the photoconductor drum and the transfer roller are opposed to each other, for feeding the transfer sheet, transfer sheet guide means disposed between the register roller pair and the transfer area for guiding the transfer sheet fed by the register roller pair toward a predetermined position on the peripheral surface of the photoconductor drum, and a fixing roller pair for fixing the toner image transferred to the transfer sheet by the passage of the transfer sheet through the transfer area, wherein the transfer sheet guide means comprises an inner guide plate and an outer guide plate, the inner guide plate having a linear guide portion extending toward the predetermined position on the peripheral surface of the photoconductor drum, the predetermined position is set in an angular range (θ) covering 12° to 23° upstream, in the direction of rotation of the photoconductor drum, from a line connecting the center of rotation of the photoconductor drum to the center of rotation of the transfer roller, and the linear guide portion of the inner guide plate forms an angle (α) of 19° to 30° with a tangent to the photoconductor drum at the predetermined position.

Preferably, the photoconductor drum has a diameter of 25 to 35 mm.

DETAILED DESCRIPTION OF THE PREFERRED EMBODIMENTS

An embodiment of an image forming machine with a transfer roller constructed in accordance with the present invention will now be described in detail with reference to the accompanying drawings.

Figure 1:
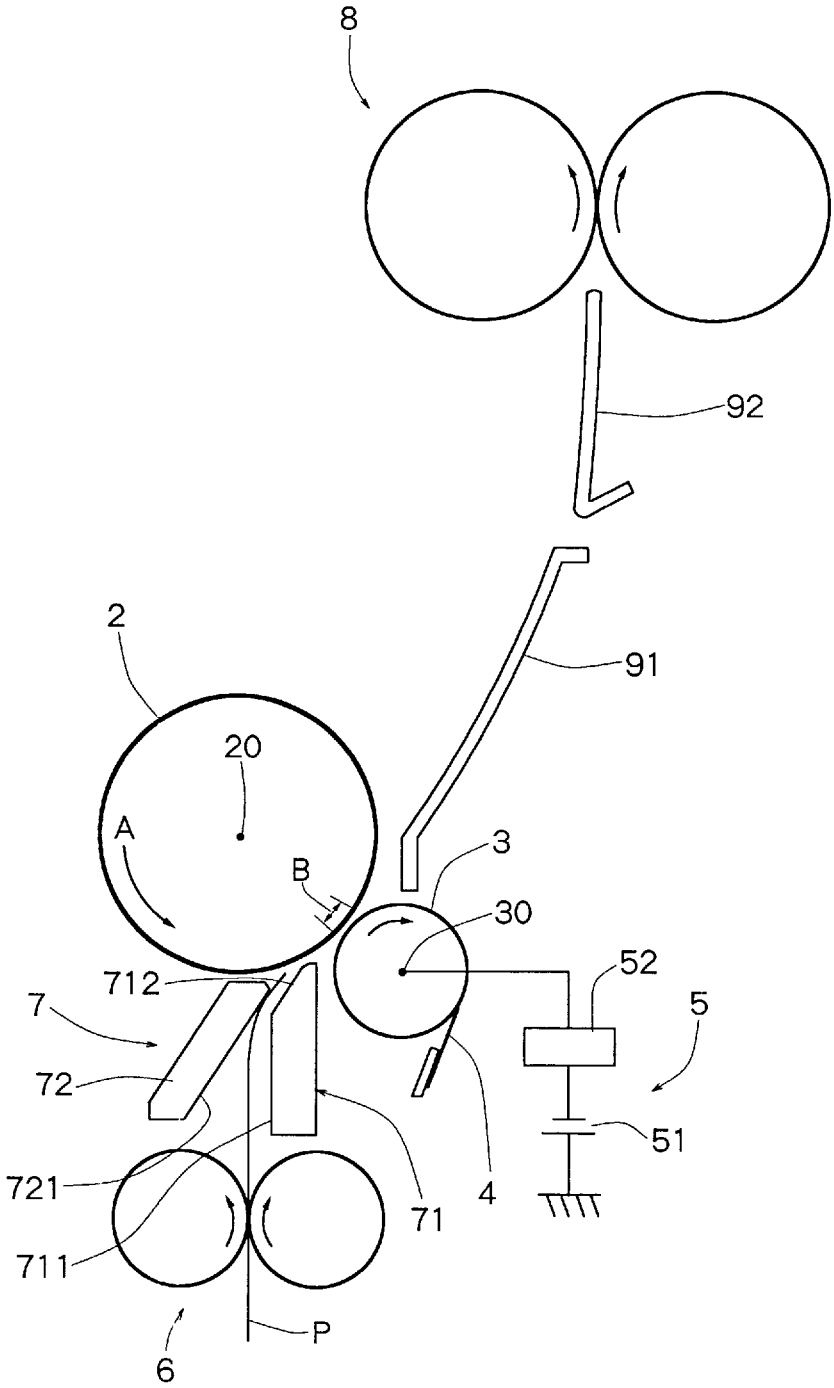
FIG. 1 a front view schematically showing an embodiment of an image forming machine with a transfer roller constructed in accordance with the present invention.
Figure 2:
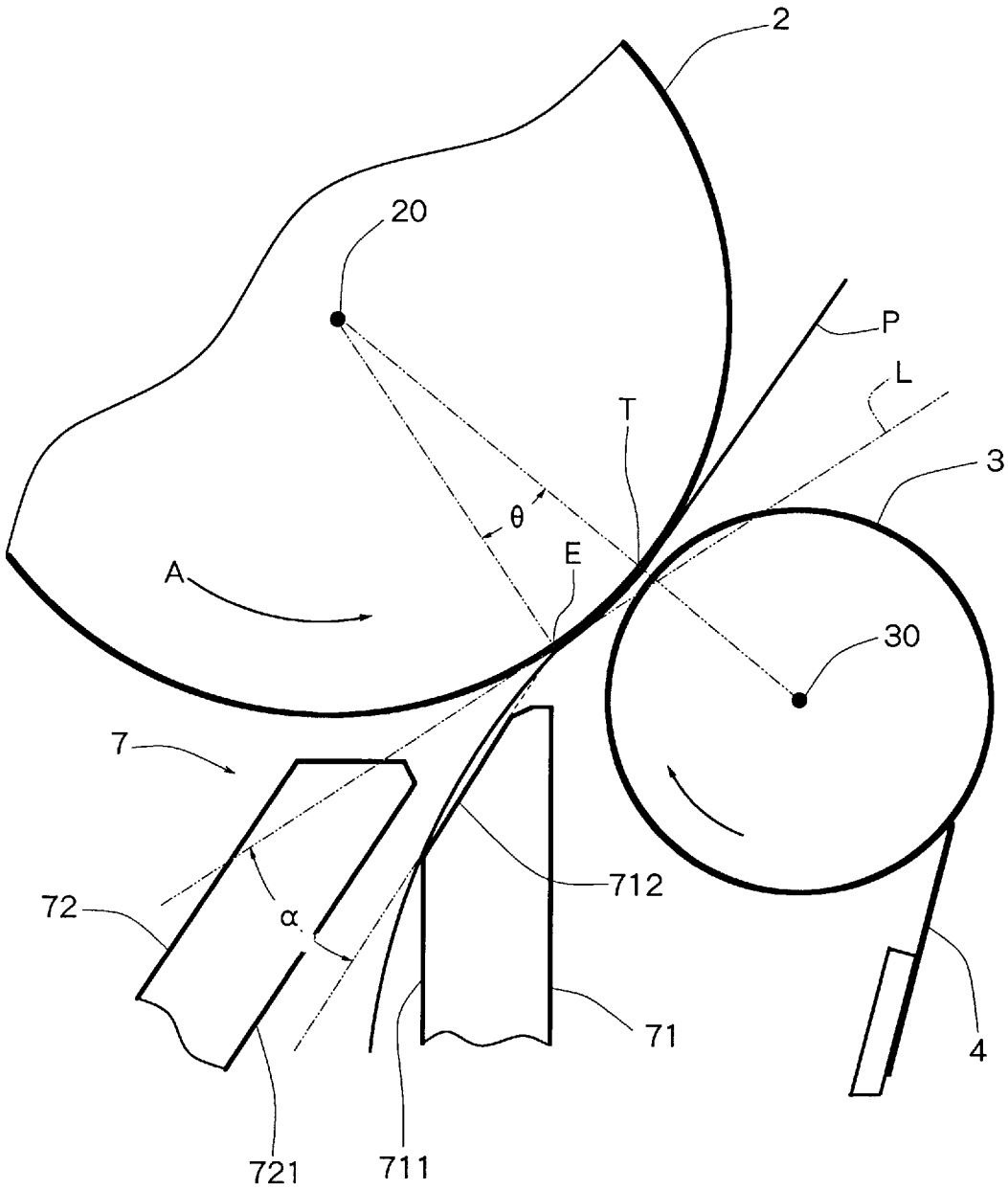
FIG. 2 is an explanation drawing showing in an enlarged manner the essential part of the image forming machine with the transfer roller illustrated in FIG. 1.
Figure 3:
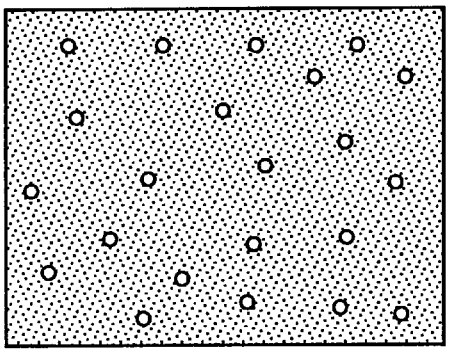
FIG. 3 is a view showing a polka dot phenomenon in a transferred image.

FIGS. 1 and 2 show an embodiment of an image forming machine with a transfer roller constructed in accordance with the invention.

In FIG. 1, a photoconductor drum as an image bearing member, designated as the numeral 2, is disposed rotatably in a machine body housing, and rotationally driven by a drive mechanism (not shown) in the direction shown by an arrow A. In the illustrated embodiment, the photoconductor drum 2 is composed of a cylinder of an aluminum alloy 25 to 35 mm in diameter. On the peripheral surface of the photoconductor drum 2, an organic photosensitive layer containing a carrier generation agent and a carrier transport agent is formed. The peripheral surface of the photoconductor drum 2 rotating in the direction of the arrow A is uniformly charged to a specific polarity (e.g., +800 V) by a charger in a charging area. On the so charged peripheral surface of the photoconductor drum 2, an electrostatic latent image of image information is formed by exposure means, such as a laser unit, in an electrostatic latent image forming area. The electrostatic latent image so formed on the peripheral surface of the photoconductor drum 2 is developed to a toner image by a developing device in a developing area. The toner image formed on the peripheral surface of the photoconductor drum 2 is transferred to a transfer sheet when passing through a transfer area B as will be described later on.

In the transfer area B, a transfer roller 3 as transfer means is disposed. The gap between the peripheral surface of the transfer roller 3 and the peripheral surface of the photoconductor drum 2 is set to be larger than the thickness of a transfer sheet. In the illustrated embodiment, this gap is set at 0.3 to 0.4 mm. The transfer roller 3 is formed of solid type urethane rubber having an Asker C hardness of about 70 to 78, and its volume resistivity is set at about $10^6$ to $10^8$ Ω·cm. The so constituted transfer roller 3 is rotationally driven by a drive mechanism (not shown) in the direction of an arrow. A peripheral surface position of the photoconductor drum 2 on a line connecting the center of rotation 20 of the photoconductor drum 2 to the center of rotation 30 of the transfer roller 3 serves as a transfer point (T). In the illustrated embodiment, a cleaning plate 4 is disposed so as to be pressed against the peripheral surface of the transfer roller 3. The cleaning plate 4 is composed of a plastic film such as polyethylene terephthalate (PET), and scrapes off a toner adhering to the peripheral surface of the transfer roller 3 to clean this surface. In the illustrated embodiment, as aforementioned, the transfer roller 3 is formed of solid type urethane rubber having an Asker C hardness of about 70 to 78, a high hardness for a rubber material. Thus, the peripheral surface of the transfer roller 3 does not elastically escape during the scraping-off of the adhering toner by the cleaning plate 4. Hence, the toner adhering to the peripheral surface of the transfer roller 3 is reliably removed.

The transfer roller 3 constituted as above is connected to bias voltage applicator means 5. The bias voltage applicator means 5 comprises a power source 51 and a constant current controller 52, and applies to the transfer roller 3 a predetermined constant current (e.g., −0.5 to −15 μA) of a polarity opposite to the charge polarity (positive polarity in the illustrated embodiment) of the toner adhering to the peripheral surface of the photoconductor drum 2. The voltage in this case is −1 to −2 V in the illustrated embodiment.

The image forming machine in the illustrated embodiment includes a register roller pair 6 disposed upstream of the transfer area B in the direction of carriage of a transfer sheet, and constituting a transfer sheet feeder for feeding a transfer sheet P toward the photoconductor drum 2. The register roller pair 6 transiently stops a transfer sheet sent by feed means constituting the transfer sheet feeder. Then, the register roller pair 6 is rotationally driven in the direction of arrows in timed relationship with the toner image formed on the peripheral surface of the photoconductor drum 2, thereby to feed the transfer sheet toward the photoconductor drum 2.

Between the register roller pair 6 and the transfer area B, transfer sheet guide means 7 is disposed for guiding the transfer sheet P conveyed by the register roller pair 6. The transfer sheet guide means 7 in the illustrated embodiment comprises an inner guide plate 71 and an outer guide plate 72. The inner guide plate 71 and the outer guide plate 72 will be described with reference to FIG. 2.

The inner guide plate 71 has a first guide portion 711 extending from the register roller pair 6 upward in the drawing, and a second guide portion 712 formed downstream of the first guide portion 711 in the direction of carriage of a transfer sheet and extending linearly toward a predetermined position (E) upstream of the transfer point (T) in the direction of rotation of the photoconductor drum 2. In the illustrated embodiment, the angle (θ) from the transfer point (T) to the predetermined position (E) upstream of the transfer point (T) in the direction of rotation of the photoconductor drum 2 is set to fall within an angular range covering an angle of 12° to 23°. If this angle (θ) is less than 12°, a transfer failure may occur. If the angle (θ) is more than 23°, the aforementioned polka dot phenomenon may occur in a transferred image in a portion of the transfer sheet that has passed through the transfer area after the front end of the transfer sheet was nipped by the fixing roller pair to be described later on. In the illustrated embodiment, the angle (α) between the second guide portion 712 of the inner guide plate 71 and a tangent (L) to the photoconductor drum 2 at the predetermined position (E) is set to be in a 19° to 30° angular range. If this angle (α) is less than 19°, a transfer failure occurs. If the angle (α) is more than 30°, a polka dot phenomenon develops.

The outer guide plate 72 has a guide portion 721 to be contacted by a transfer sheet P which is fed from the register roller pair 6. This guide portion 721 is formed to make a predetermined angle with the direction of carriage from the register roller pair 6 so as to guide the transfer sheet P toward the predetermined position (E).

Returning to FIG. 1, a description will be offered. A fixing roller pair 8 as fixing means is disposed downstream of the transfer area B in the direction of carriage of the transfer sheet. The fixing roller pair 8 has heating means disposed on at least one of the constituent pair of rollers, and this one roller is rotationally driven in the direction of an arrow. By the passage of the transfer sheet P through the fixing roller pair 8, the toner image transferred to the transfer sheet P is thermally fixed. Between the transfer area B and the fixing roller pair 8, transfer sheet guide plates 91, 92 are disposed. The transfer sheet P having the toner image transferred thereto in the transfer area B is guided by the transfer sheet guide plates 91, 92 toward the fixing roller pair 8.

The image forming machine with the transfer roller in the illustrated embodiment is constituted as described above. Its actions will be explained below.

The transfer sheet P fed by the feed means constituting the transfer sheet feeder (not shown) contacts the nip site of the register roller pair 6 and transiently stops. At this time, the inclination of the skew fed transfer sheet P is corrected. Then, the register roller pair 6 is driven in timed relationship with the toner image formed on the peripheral surface of the photoconductor drum 2, thereby to feed the transfer sheet P upward in FIG. 1 between the inner guide plate 71 and the outer guide plate 72 constituting the transfer sheet guide means 7. The transfer sheet P fed by the register roller pair 6 changes its direction of carriage upon contact of its front end with the guide portion 721 of the outer guide plate 72. Then, the transfer sheet P is conveyed toward the predetermined position (E) upstream of the transfer point (T) in the direction of rotation of the photoconductor drum 2. Upon contact of its front end with the peripheral surface of the photoconductor drum 2 near the predetermined position (E), the transfer sheet P is carried along the photoconductor drum 2. When the transfer sheet P passes through the transfer area B, the transfer roller 3 receives from the bias voltage applicator means 5 a constant current of a polarity opposite to the charge polarity of the toner adhering to the peripheral surface of the photoconductor drum 2. Thus, a very small corona discharge current is applied by the transfer roller 3 to the back of the transfer sheet P. Because of this tiny corona discharge current applied to the back of the transfer sheet P, the toner image formed on the peripheral surface of the photoconductor drum 2 is transferred to the surface of the transfer sheet P. The transfer sheet P bearing the transferred toner image is separated from the photoconductor drum 2, guided by the transfer sheet guide plates 91, 92, and carried toward the fixing roller pair 8. While the transfer sheet P is passing through the fixing roller pair 8, the toner image transferred to the surface of the transfer sheet P is thermally fixed.

When the front end of the transfer sheet P is nipped by the fixing roller pair 8, the transfer sheet P is conveyed by the fixing roller pair 8. Thus, the transfer sheet P on the photoconductor drum 2 side relative to the fixing roller pair 8 is pulled by the conveying force of the fixing roller pair 8. As a result, the transfer sheet P rearward of a site close to the predetermined position (E) is brought toward the second guide portion 712 of the inner guide plate 71 as shown in FIG. 2, and sent toward the predetermined position (E) along the second guide portion 712. When the transfer sheet P is pulled in accordance with the carriage of the transfer sheet P by the fixing roller pair 8, as stated above, the degree of intimate contact of the transfer sheet P with the peripheral surface of the photoconductor drum 2 tends to increase. In the illustrated embodiment, however, the contact angular range (θ) from the transfer point (T) to the predetermined position (E) is set to be an angular range of 12° to 23°. Thus, the increase in the degree of intimate contact is minimal and does not affect a transferred image. Furthermore, the second guide portion 712 of the inner guide plate 71, a guide surface for the transfer sheet P after carriage of the transfer sheet P by the fixing roller pair 8, forms the angle (α) with the tangent (L) to the photoconductor drum 2 at the predetermined position (E), the angle being set in an angular range of 19° to 30°. Hence, the polka dot phenomenon or transfer failure does not occur.

EXAMPLE 1

An image forming machine as illustrated and described above was constituted by using a photoconductor drum 2 with a diameter of 30 mm, setting the contact angular range (θ) from the transfer point (T) to the predetermined position (E) at 17.6°, and setting the angle (α) between the second guide portion 712 of the inner guide plate 71 and the tangent (L) to the photoconductor drum 2 at the predetermined position (E) at 24.2°. Experiments were conducted using this image forming machine. Neither a polka dot phenomenon nor a transfer failure occurred.

EXAMPLE 2

Experiments were conducted under the same conditions as in Example 1, except that the contact angular range (θ) was set at 12.6°, a value 5° less than that in Example 1. Neither a polka dot phenomenon nor a transfer failure occurred.

EXAMPLE 3

Experiments were conducted under the same conditions as in Example 1, except that the contact angular range (θ) was set at 22.6°, a value 5° more than that in Example 1. Neither a polka dot phenomenon nor a transfer failure occurred.

EXAMPLE 4

Experiments were conducted under the same conditions as in Example 1, except that the angle (α) was set at 19.20, a value 5° less than that in Example 1. Neither a polka dot phenomenon nor a transfer failure occurred.

EXAMPLE 5

Experiments were conducted under the same conditions as in Example 1, except that the angle (α) was set at 29.2°, a value 5° more than that in Example 1. Neither a polka dot phenomenon nor a transfer failure occurred.

COMPARATIVE EXAMPLE

Experiments were conducted under the same conditions as in Example 1, except that the contact angular range (θ) was set at 24.4°, and the angle (α) at 38.1°. A polka dot phenomenon occurred.

The foregoing results of the experiments showed that neither a polka dot phenomenon nor a transfer failure occurred when the contact angular range (θ) from the transfer point (T) to the predetermined position (E) was set at 12° to 23°, and the angle (α) between the second guide portion 712 of the inner guide plate 71 and the tangent (L) to the photoconductor drum 2 at the predetermined position (E) was set at 19° to 30°.

What we claim is:

1. An image forming machine having a transfer roller, comprising:

a photoconductor drum disposed rotatably and having a peripheral surface on which a toner image is formed;

a transfer roller disposed opposite said photoconductor drum with a predetermined gap provided therebetween for transferring a toner image formed on the peripheral surface of said photoconductor drum to a transfer sheet;

a register roller pair disposed upstream, in the direction of carriage of a transfer sheet, of a transfer area where said photoconductor drum and said transfer roller are opposed to each other, for feeding the transfer sheet;

transfer sheet guide means disposed between said register roller pair and the transfer area for guiding the transfer sheet fed by said register roller pair toward a predetermined position on the peripheral surface of said photoconductor drum; and a fixing roller pair for fixing the toner image transferred to the transfer sheet by the passage of the transfer sheet through the transfer area; wherein said transfer sheet guide means comprises an inner guide plate and an outer guide plate, said inner guide plate having a linear guide portion extending toward the predetermined position on the peripheral surface of said photoconductor drum, said predetermined position is set in an angular range (θ) covering 12° to 23° upstream, in the direction of rotation of the photoconductor drum, from a line connecting the center of rotation of said photoconductor drum to the center of rotation of said transfer roller, and the linear guide portion of said inner guide plate forms an angle (α) with a tangent to said photoconductor drum at the predetermined position, said angle (α) being set at 19° to 30°.

2. An image forming machine having a transfer roller as claimed in claim 1, wherein said photoconductor drum has a diameter of 25 to 35 mm.

* * * * *